US009830871B2

(12) United States Patent
Slavenburg et al.

(10) Patent No.: US 9,830,871 B2
(45) Date of Patent: Nov. 28, 2017

(54) DC BALANCING TECHNIQUES FOR A VARIABLE REFRESH RATE DISPLAY

(71) Applicant: NVIDIA Corporation, Santa Clara, CA (US)

(72) Inventors: Gerrit Slavenburg, Hayward, CA (US); Robert Schutten, San Jose, CA (US); Tom Verbeure, Sunnyvale, CA (US)

(73) Assignee: NVIDIA CORPORATION, Santa Clara, CA (US)

( * ) Notice: Subject to any disclaimer, the term of this patent is extended or adjusted under 35 U.S.C. 154(b) by 64 days.

(21) Appl. No.: 14/147,365

(22) Filed: Jan. 3, 2014

(65) Prior Publication Data

US 2015/0194111 A1 Jul. 9, 2015

(51) Int. Cl.
*G09G 3/36* (2006.01)

(52) U.S. Cl.
CPC ..... *G09G 3/3618* (2013.01); *G09G 3/3614* (2013.01); *G09G 2310/08* (2013.01)

(58) Field of Classification Search
CPC .. G09G 3/36; G09G 5/00; G09G 5/10; G09G 3/3618; G09G 3/3614; G09G 2310/08; G06F 3/038
See application file for complete search history.

(56) References Cited

U.S. PATENT DOCUMENTS 5,801,780 A 9/1998 Schaumont et al.
6,141,461 A 10/2000 Carlini
6,249,549 B1 6/2001 Kim
6,804,418 B1 10/2004 Yu et al.
8,139,081 B1 3/2012 Daniel
8,218,860 B1 7/2012 Berger et al.
2002/0101432 A1 8/2002 Ohara et al.
2004/0052432 A1 3/2004 Lee et al.
2004/0119887 A1 6/2004 Franzen
2004/0263495 A1 12/2004 Sugino et al.
2005/0162566 A1 7/2005 Chuang et al.
2005/0212740 A1 9/2005 Miyagawa
2007/0109256 A1 5/2007 Fry
2007/0120793 A1 5/2007 Kimura
2008/0309656 A1* 12/2008 Van Woudenberg et al. ..... 345/214
2009/0027545 A1 1/2009 Yeo et al.
2009/0179923 A1* 7/2009 Amundson et al. ..... 345/690
2009/0219244 A1 9/2009 Fletcher et al.
2009/0257621 A1 10/2009 Silver
2009/0313484 A1 12/2009 Millet et al.
2010/0253611 A1 10/2010 Takagi et al.
(Continued)

*Primary Examiner* — Lun-Yi Lao
*Assistant Examiner* — Johny Lau

(57) ABSTRACT

A method for driving a display panel having a variable refresh rate is disclosed. The method comprises detecting a condition that results in a charge accumulation in the display panel using an accumulated difference in time duration between frames of positive polarity and frames of negative polarity received from an image source. The DC imbalance is a result of a frame pattern comprising alternating frames of differing polarities, wherein frames of positive polarity within the frame pattern are of a different time duration than frames of negative polarity, and wherein the frame pattern results in an accumulation of charge in pixels of the display panel. The method also comprises correcting for the charge accumulation by disrupting the frame pattern.

18 Claims, 11 Drawing Sheets

| | Frame Nr | Frame Arrival Time (ms) | LCD Refresh Start Time (ms) | Duration (ms) | Polarity | Comment |
|---|---|---|---|---|---|---|
| | 1 | 0 | 0 | 10 | + | |
| | 2 | 10 | 10 | 8 | - | |
| | 3 | 18 | 18 | 8 | + | |
| 638 | 3' | | 26 | 8 | - | Frame 3 repeated |
| 639 | 4 | 28 | 34 | 8 | + | Delay of 6ms |
| 640 | 5 | 36 | 42 | 8 | - | Delay of 6ms |
| 633 | 6 | 46 | 50 | 8 | + | Delay of 4ms |
| 634 | 7 | 54 | 58 | 8 | - | Delay of 4ms |
| 635 | 8 | 64 | 66 | 8 | + | Delay of 2ms |
| 636 | 9 | 72 | 74 | 8 | - | Delay of 2ms |
| 637 | 10 | 82 | 82 | 8 | + | No Delay |
| | 11 | 88 | 88 | 10 | - | No Delay |

(56) References Cited

U.S. PATENT DOCUMENTS

| | | | | |
|---|---|---|---|---|
| 2010/0302269 | A1 | 12/2010 | Morimoto | |
| 2011/0261094 | A1 | 10/2011 | Ruckmongathan | |
| 2011/0273482 | A1 | 11/2011 | Massart et al. | |
| 2011/0285683 | A1* | 11/2011 | Todorovich et al. | 345/208 |
| 2011/0292246 | A1 | 12/2011 | Brunner | |
| 2012/0176396 | A1 | 7/2012 | Harper et al. | |
| 2012/0201476 | A1 | 8/2012 | Carmel et al. | |
| 2013/0015770 | A1 | 1/2013 | Aitken | |
| 2013/0063469 | A1 | 3/2013 | Ruckmongathan | |
| 2013/0107120 | A1 | 5/2013 | Inoue et al. | |
| 2013/0249880 | A1 | 9/2013 | Chen et al. | |
| 2014/0139706 | A1 | 5/2014 | Jang et al. | |
| 2014/0168185 | A1 | 6/2014 | Han et al. | |
| 2014/0307962 | A1 | 10/2014 | Seikh | |
| 2014/0333516 | A1* | 11/2014 | Park | G09G 3/3614 345/89 |
| 2014/0368484 | A1 | 12/2014 | Tanaka et al. | |
| 2015/0243233 | A1 | 8/2015 | Bloks et al. | |
| 2015/0243234 | A1 | 8/2015 | Bloks et al. | |

* cited by examiner 230
240

| Frame Nr | Frame Arrival Time (ms) | LCD Refresh Start Time (ms) | Duration (ms) | Polarity | Comment |
|---|---|---|---|---|---|
| 1 | 0 | 0 | 30 | + | |
| 1' | | 30 | 10 | - | Frame 1 repeat |
| 2 | 40 | 40 | 30 | + | |
| 2' | | 70 | 10 | - | Frame 2 repeat |

FIG. 2

330

```
delta_duration = last_positive_frame_duration - last_negative_frame_duration;
cumulative_charge = (leakage_factor * cumulative_charge) + (delta_duration * scaling_factor)
```

340

FIG. 3

430

431

| Frame Nr | Frame Arrival Time (ms) | LCD Refresh Start Time (ms) | Duration (ms) | Polarity | Comment |
|---|---|---|---|---|---|
| 1 | 0 | 0 | 20 | + | |
| 2 | 20 | 20 | 15 | - | |
| 3 | 35 | 35 | 20 | + | |
| 4 | 55 | 55 | 15 | - | |

FIG. 4A

432

433

| Frame Nr | Frame Arrival Time (ms) | LCD Refresh Start Time (ms) | Duration (ms) | Polarity | Comment |
|---|---|---|---|---|---|
| 1 | 0 | 0 | 20 | + | |
| 2 | 20 | 20 | 15 | - | |
| 3 | 35 | 35 | 20 | - | Frame 3 has same polarity as frame 2, reversing the pattern |
| 4 | 55 | 55 | 15 | + | |

FIG. 4B 530
531

| Frame Nr | Frame Arrival Time (ms) | LCD Refresh Start Time (ms) | Duration (ms) | Polarity | Comment |
|---|---|---|---|---|---|
| 1 | 0 | 0 | 20 | + | |
| 2 | 20 | 20 | 15 | - | |
| 3 | 35 | 35 | 20 | + | |
| 4 | 55 | 55 | 15 | - | |

FIG. 5A 532
533
534

| Frame Nr | Frame Arrival Time (ms) | LCD Refresh Start Time (ms) | Duration (ms) | Polarity | Comment |
|---|---|---|---|---|---|
| 1 | 0 | 0 | 20 | + | |
| 2 | 20 | 20 | 15 | - | |
| 3 | 35 | 35 | 8 | + | |
| 3' | | 43 | 12 | - | Frame insertion |
| 4 | 55 | 55 | 15 | + | Polarity reversed compared to original. |

FIG. 5B 630
631
632

| Frame Nr | Frame Arrival Time (ms) | LCD Refresh Start Time (ms) | Duration (ms) | Polarity | Comment |
|---|---|---|---|---|---|
| 1 | 0 | 0 | 10 | + | |
| 2 | 10 | 10 | 8 | - | |
| 3 | 18 | 18 | 10 | + | |
| 4 | 28 | 28 | 8 | - | |
| 5 | 36 | 36 | 10 | + | |
| 6 | 46 | 46 | 8 | - | |
| 7 | 54 | 54 | 10 | + | |
| 8 | 64 | 64 | 8 | - | |
| 9 | 72 | 72 | 10 | + | |
| 10 | 82 | 82 | 8 | - | |
| 11 | 88 | 88 | 10 | + | |

FIG. 6A 638
639
640
633
634
635
636
637

| Frame Nr | Frame Arrival Time (ms) | LCD Refresh Start Time (ms) | Duration (ms) | Polarity | Comment |
|---|---|---|---|---|---|
| 1 | 0 | 0 | 10 | + | |
| 2 | 10 | 10 | 8 | - | |
| 3 | 18 | 18 | 8 | + | |
| 3' | | 26 | 8 | - | Frame 3 repeated |
| 4 | 28 | 34 | 8 | + | Delay of 6ms |
| 5 | 36 | 42 | 8 | - | Delay of 6ms |
| 6 | 46 | 50 | 8 | + | Delay of 4ms |
| 7 | 54 | 58 | 8 | - | Delay of 4ms |
| 8 | 64 | 66 | 8 | + | Delay of 2ms |
| 9 | 72 | 74 | 8 | - | Delay of 2ms |
| 10 | 82 | 82 | 8 | + | No Delay |
| 11 | 88 | 88 | 10 | - | No Delay |

FIG. 6B 730
731
732

| Frame Nr | Frame Arrival Time (ms) | LCD Refresh Start Time (ms) | Duration (ms) | Polarity | Comment |
|---|---|---|---|---|---|
| 1 | 0 | 0 | 20 | + | |
| 1' | | 20 | 20 | - | Frame 1 repeat. Duration constant at 20ms. |
| 2 | 40 | 40 | 20 | + | |
| 2' | | 60 | 20 | - | Frame 2 repeat. Duration constant at 20ms. |

FIG. 7

| Frame Nr | Frame Arrival Time (ms) | LCD Refresh Start Time (ms) | Duration (ms) | Polarity | Comment |
|---|---|---|---|---|---|
| 1 | 0 | 0 | 10 | + | |
| 2 | 10 | 10 | 8 | - | |
| 3 | 18 | 18 | 10 | + | |
| 4 | 28 | 28 | 8 | - | |
| 5 | 36 | 36 | 10 | + | |
| 6 | 46 | 46 | 8 | - | |

FIG. 8A

830

831

| Frame Nr | Frame Arrival Time (ms) | LCD Refresh Start Time (ms) | Duration (ms) | Polarity | Comment |
|---|---|---|---|---|---|
| 1 | 0 | 0 | 10 | + | |
| 2 | 10 | 10 | 8 | - | |
| 3 | 18 | 18 | 10 | + | |
| 4 | 28 | | | | Frame not shown at all! |
| 5 | 36 | 36 | 10 | - | Polarity of frame 5 and following is now reversed. |
| 6 | 46 | 46 | 8 | + | |

FIG. 8B

| Frame Nr | Frame Arrival Time (ms) | LCD Refresh Start Time (ms) | Duration (ms) | Polarity | Comment |
|---|---|---|---|---|---|
| 1 | 0 | 0 | 12 | + | |
| 2 | 12 | 12 | 10 | - | |
| 3 | 22 | 22 | 12 | + | |
| 4 | 34 | 34 | 10 | - | |
| 5 | 44 | 44 | 12 | + | |
| 6 | 56 | 56 | 10 | - | |
| 7 | 66 | 66 | 12 | + | |

FIG. 9A

930

931

| Frame Nr | Frame Arrival Time (ms) | LCD Refresh Start Time (ms) | Duration (ms) | Polarity | Comment |
|---|---|---|---|---|---|
| 1 | 0 | 0 | 12 | + | |
| 2 | 12 | 12 | 11 | - | |
| 3 | 22 | 23 | 11 | + | Delay refresh start by 1 ms |
| 4 | 34 | 34 | 11 | - | |
| 5 | 44 | 45 | 11 | + | Delay refresh start by 1 ms |
| 6 | 56 | 56 | 11 | - | |
| 7 | 66 | 67 | 11 | + | Delay refresh start by 1 ms |

FIG. 9B

1032

| Frame Nr | Frame Arrival Time (ms) | LCD Refresh Start Time (ms) | Duration (ms) | Polarity | Comment |
|---|---|---|---|---|---|
| 1 | 0 | 0 | 20 | + | |
| 2 | 20 | 20 | 15 | - | |
| 3 | 35 | 35 | 20 | + | |
| 4 | 55 | 55 | 15 | - | |
| 5 | 70 | 70 | 30 | + | Frame that doesn't fit the steady state beat pattern. |
| 6 | 100 | 100 | 20 | - | The 20ms phase now has the opposite polarity than before. |
| 7 | 120 | 120 | 15 | + | |

FIG. 10

DC BALANCING TECHNIQUES FOR A VARIABLE REFRESH RATE DISPLAY

BACKGROUND OF THE INVENTION

Traditionally, LCD displays had a fixed refresh rate, wherein the contents of the screen are refreshed at fixed time intervals, e.g., at 60 Hz. While fixed refresh rates performed adequately for certain applications, e.g., T.V. shows, other applications, e.g., gaming suffered. Depending on the complexity of the calculations, the graphics processing unit (GPU) used to render gaming graphics for an LCD display renders frames at varying rates. The difference in the rendering rate of the GPU and the fixed refresh rate of the LCD results in conspicuous visual artifacts that distort a user's experience of the game.

Variable refresh rate monitors alleviate this problem by requiring the LCD screen to sync with the GPU instead of refreshing at a fixed rate. The GPU sends an image to the LCD as soon as it is rendered and the LCD monitor repaints the image. Subsequently, the LCD waits for the next image to be transmitted from the GPU. This reduces artifacts like stutter and tearing and results in smoother on-screen motion. However, because of the variable refresh rate, each RGB component of a pixel can start to accumulate charge if positive and negative polarity frame durations are not equal because of an unbalanced polarity pattern (also called a beat pattern).

The intensity of each one of the RGB components of a pixel of a liquid crystal display ("LCD") is determined by the voltage difference that is applied to the pixel cell. In the neutral state, no voltage is applied. In the active state, the voltage can either have positive or negative polarity. It should be noted that both positive and negative polarities result in the same intensity of color on the LCD screen. As the voltage is applied to a pixel cell, the RGB component of a pixel (hereinafter, each RGB component of a pixel will be referred to as a "pixel") may slowly accumulate a charge. When this charge is present, the intensity of the pixel will be different than when the charge is not present, even in cases where the same voltage is applied.

Over time, the charge accumulation inside a component dot of a pixel will result in visual artifacts. For example, the intensity of the pixel will be different when a positive voltage is applied than when a negative voltage is applied. If the polarity changes for each frame displayed, the pixel will alternately have different values, which can be observed as flicker.

To avoid this charge accumulation and flicker, the driving electronics of the LCD panel need to ensure that the average charge in the pixels stays close to zero, which means that the average voltage applied over time should approximately be zero also. It should be noted that because the charge inside a pixel leaks away over time, similar to a leaky capacitor, the average voltage applied does not have to be exactly zero.

In a display with a fixed refresh rate, ensuring that the average voltage applied is zero can be accomplished by alternately applying a positive and negative voltage across the pixels. The polarity of the voltage on each pixel is typically changed for each frame for a regular 2D display, e.g., in the following pattern:(+−+−+−+−). For some stereo 3D displays, for example, the polarity of the voltage on each pixel may change in the following fashion: (++−−++−−++−−++).

In a variable rate display, however, ensuring that the average voltage charge applied stays close to zero is more challenging. Conventional variable rate LCD displays do not have an efficient mechanism for ensuring that the average voltage applied over time stays close to zero and, therefore, undesirable parasitic charge can build up for the pixels of the LCD screen which causes visible artifacts.

BRIEF SUMMARY OF THE INVENTION

Accordingly a need exists for a method and apparatus to prevent charge accumulation within the component dots of pixels in a variable refresh rate display. Embodiments of the present invention provide a method for preventing charge accumulation and resultant visual artifacts by dynamically analyzing a sequence of frames to detect any DC imbalance building up within the pixels of the LCD panel. Further, embodiments of the present invention can advantageously perform DC imbalance remediation that cures the DC imbalance by using one of several techniques. The novel DC imbalance remediation procedure advantageously breaks the unbalanced polarity pattern or beat pattern that may result in the charge running away.

In one embodiment, for example, the DC imbalance remediation procedure of the present invention breaks the unbalanced polarity pattern by controlling the polarity of the LCD panel, wherein the positive polarity on a frame may be switched to negative polarity, or vice versa, in order to combat the DC imbalance. In another embodiment, the DC imbalance remediation procedure of the present invention breaks the beat pattern by forcing a repeat of a frame to reverse the beat pattern into a reverse beat pattern. In yet another embodiment, the DC imbalance remediation procedure of the present invention breaks the beat pattern by dropping a frame completely to reverse the beat pattern into a reverse beat pattern. In a different embodiment, the DC imbalance remediation procedure of the present invention adjusts the refresh times of individual frames in order to even out the positive and negative polarity intervals. Finally, in one embodiment, the DC imbalance remediation procedure of the present invention adjusts or slows down the rendering or transfer rate of the images from the image source to break the beat pattern.

In one embodiment, a method for driving a display panel having a variable refresh rate is disclosed. The method comprises detecting a condition that results in a charge accumulation in the display panel using an accumulated difference in time duration between frames of positive polarity and frames of negative polarity received from an image source. The DC imbalance is a result of a frame pattern comprising alternating frames of differing polarities, wherein frames of positive polarity within the frame pattern are of a different time duration than frames of negative polarity, and wherein the frame pattern results in an accumulation of charge in pixels of the display panel. The method also comprises correcting for the charge accumulation by disrupting the frame pattern.

In one embodiment, a system comprising a variable refresh rate display, a memory for storing images from an image source and a processor coupled to the memory is disclosed. The processor is operable to implement a method for controlling the variable refresh rate display. The method comprises: (a) detecting a condition that results in a DC imbalance in the variable refresh rate display using an accumulated difference in time duration between frames of positive polarity and frames of negative polarity received from the image source, wherein the DC imbalance is a result of a frame pattern comprising alternating frames of differing polarities, wherein frames of positive polarity within the frame pattern are of a different time duration than frames of negative polarity, and wherein the frame pattern results in an accumulation of charge in pixels of the variable refresh rate display; and (b) correcting for the DC imbalance by disrupting the frame pattern.

In a different embodiment, a method for controlling a display panel with a variable refresh rate is disclosed. The method comprises determining intervals to perform DC imbalance correction in a variable refresh rate display using a pseudo-random generator. The DC imbalance is a result of a frame pattern comprising alternating frames of differing polarities, wherein frames of positive polarity within the frame pattern are of a different time duration than frames of negative polarity, and wherein the frame pattern results in an accumulation of charge in pixels comprising the variable refresh rate display. The method also comprises correcting for the DC imbalance at the intervals by disrupting the frame pattern.

The following detailed description together with the accompanying drawings will provide a better understanding of the nature and advantages of the present invention.

BRIEF DESCRIPTION OF THE DRAWINGS

Embodiments of the present invention are illustrated by way of example, and not by way of limitation, in the figures of the accompanying drawings and in which like reference numerals refer to similar elements.

FIG. 2 illustrates the manner in which repeating a prior frame to ensure that the refresh rate will not fall below a minimum threshold can result in a DC imbalance.

FIG. 3 illustrates computer code for computing the accumulated time duration and modeling the charge leakage for the DC imbalance detection procedure in accordance with embodiments of the invention.

FIG. 4A illustrates an exemplary beat pattern.

FIG. 4B illustrates the manner in which the exemplary beat pattern of

FIG. 4A can be reversed by controlling the driving electronics of the LCD panel in accordance with embodiments of the invention.

FIG. 5A illustrates an exemplary beat pattern.

FIG. 5B the manner in which the exemplary beat pattern of FIG. 5A can be reversed by repeating a prior frame in accordance with embodiments of the invention.

FIG. 6A illustrates an exemplary pattern wherein, assuming a minimum refresh time of 8 ms, the delay between any pair of frames is not long enough to prevent a temporal collision between a repeated frame and the next incoming frame.

FIG. 6B illustrates the manner in which start times of frames are delayed for the exemplary pattern illustrated in FIG. 6 in order to repeat a frame in accordance with embodiments of the invention.

FIG. 7 illustrates the manner in which a repeated frame can be spaced evenly between a prior and a subsequent frame in accordance with embodiments of the invention FIG. 8A illustrates an exemplary beat pattern.

FIG. 8B illustrates the manner in which the exemplary beat pattern of FIG. 8A can be reversed by dropping an incoming frame in accordance with embodiments of the invention.

FIG. 9A illustrates an exemplary beat pattern.

FIG. 9B illustrates the manner in which the LCD refresh start times of the exemplary beat pattern of FIG. 9A can be continuously adjusted to prevent DC imbalance charge from building in accordance with embodiments of the invention.

FIG. 10 illustrates an exemplary beat pattern for which a high cumulative charge threshold could be problematic.

DETAILED DESCRIPTION OF THE INVENTION

Figure 1:
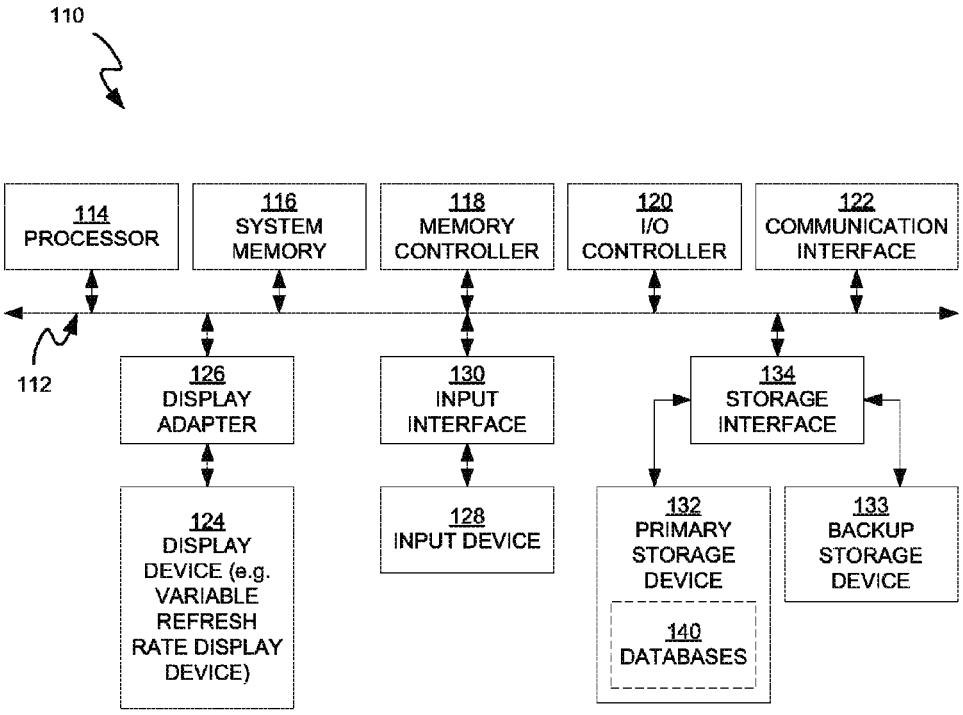
FIG. 1 is an exemplary computer system in accordance with embodiments of the present invention.

Reference will now be made in detail to the various embodiments of the present disclosure, examples of which are illustrated in the accompanying drawings. While described in conjunction with these embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Some portions of the detailed descriptions that follow are presented in terms of procedures, logic blocks, processing, and other symbolic representations of operations on data bits within a computer memory. These descriptions and representations are the means used by those skilled in the data processing arts to most effectively convey the substance of their work to others skilled in the art. In the present application, a procedure, logic block, process, or the like, is conceived to be a self-consistent sequence of steps or instructions leading to a desired result. The steps are those utilizing physical manipulations of physical quantities. Usually, although not necessarily, these quantities take the form of electrical or magnetic signals capable of being stored, transferred, combined, compared, and otherwise manipulated in a computer system. It has proven convenient at times, principally for reasons of common usage, to refer to these signals as transactions, bits, values, elements, symbols, characters, samples, pixels, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present disclosure, discussions utilizing terms such as "determining," "detecting," "performing," "displaying," or the like, refer to actions and processes (e.g., flowchart 1100 of FIG. 11) of a computer system or similar electronic computing device or processor (e.g., system 110 of FIG. 1). The computer system or similar electronic computing device manipulates and transforms data represented as physical (electronic) quantities within the computer system memories, registers or other such information storage, transmission or display devices.

Embodiments described herein may be discussed in the general context of computer-executable instructions residing on some form of computer-readable storage medium, such as program modules, executed by one or more computers or other devices. By way of example, and not limitation, computer-readable storage media may comprise non-transitory computer-readable storage media and communication media; non-transitory computer-readable media include all computer-readable media except for a transitory, propagating signal. Generally, program modules include routines, programs, objects, components, data structures, etc., that perform particular tasks or implement particular abstract data types. The functionality of the program modules may be combined or distributed as desired in various embodiments.

Computer storage media includes volatile and nonvolatile, removable and non-removable media implemented in any method or technology for storage of information such as computer-readable instructions, data structures, program modules or other data. Computer storage media includes, but is not limited to, random access memory (RAM), read only memory (ROM), electrically erasable programmable ROM (EEPROM), flash memory or other memory technology, compact disk ROM (CD-ROM), digital versatile disks (DVDs) or other optical storage, magnetic cassettes, magnetic tape, magnetic disk storage or other magnetic storage devices, or any other medium that can be used to store the desired information and that can accessed to retrieve that information.

Communication media can embody computer-executable instructions, data structures, and program modules, and includes any information delivery media. By way of example, and not limitation, communication media includes wired media such as a wired network or direct-wired connection, and wireless media such as acoustic, radio frequency (RF), infrared, and other wireless media. Combinations of any of the above can also be included within the scope of computer-readable media.

FIG. 1 is a block diagram of an example of a computing system 110 capable of implementing embodiments of the present disclosure. Computing system 110 broadly represents any single or multi-processor computing device or system capable of executing computer-readable instructions. Examples of computing system 110 include, without limitation, workstations, laptops, client-side terminals, servers, distributed computing systems, handheld devices, variable refresh rate display systems, or any other computing system or device. In its most basic configuration, computing system 110 may include at least one processor 114 and a system memory 116.

Processor 114 generally represents any type or form of processing unit capable of processing data or interpreting and executing instructions. For example, processing unit 114 may represent a central processing unit (CPU), a graphics processing unit (GPU), or both. In one embodiment, the DC imbalance detection and DC imbalance remediation procedure of the present invention is programmed into either the CPU (or GPU) 114. In certain embodiments, processor 114 may receive instructions from a software application or module. These instructions may cause processor 114 to perform the functions of one or more of the example embodiments described and/or illustrated herein.

System memory 116 generally represents any type or form of volatile or non-volatile storage device or medium capable of storing data and/or other computer-readable instructions. Examples of system memory 116 include, without limitation, RAM, ROM, flash memory, or any other suitable memory device. Although not required, in certain embodiments computing system 110 may include both a volatile memory unit (such as, for example, system memory 116) and a non-volatile storage device (such as, for example, primary storage device 132).

Computing system 110 may also include one or more components or elements in addition to processor 114 and system memory 116. For example, in the embodiment of FIG. 1, computing system 110 includes a memory controller 118, an input/output (I/O) controller 120, and a communication interface 122, each of which may be interconnected via a communication infrastructure 112. Communication infrastructure 112 generally represents any type or form of infrastructure capable of facilitating communication between one or more components of a computing device. Examples of communication infrastructure 112 include, without limitation, a communication bus (such as an Industry Standard Architecture (ISA), Peripheral Component Interconnect (PCI), PCI Express (PCIe), or similar bus) and a network.

Memory controller 118 generally represents any type or form of device capable of handling memory or data or controlling communication between one or more components of computing system 110. For example, memory controller 118 may control communication between processor 114, system memory 116, and I/O controller 120 via communication infrastructure 112.

I/O controller 120 generally represents any type or form of module capable of coordinating and/or controlling the input and output functions of a computing device. For example, I/O controller 120 may control or facilitate transfer of data between one or more elements of computing system 110, such as processor 114, system memory 116, communication interface 122, display adapter 126, input interface 130, and storage interface 134.

Communication interface 122 broadly represents any type or form of communication device or adapter capable of facilitating communication between example computing system 110 and one or more additional devices. For example, communication interface 122 may facilitate communication between computing system 110 and a private or public network including additional computing systems. Examples of communication interface 122 include, without limitation, a wired network interface (such as a network interface card), a wireless network interface (such as a wireless network interface card), a modem, and any other suitable interface. In one embodiment, communication interface 122 provides a direct connection to a remote server via a direct link to a network, such as the Internet. Communication interface 122 may also indirectly provide such a connection through any other suitable connection.

Communication interface 122 may also represent a host adapter configured to facilitate communication between computing system 110 and one or more additional network or storage devices via an external bus or communications channel. Examples of host adapters include, without limitation, Small Computer System Interface (SCSI) host adapters, Universal Serial Bus (USB) host adapters, IEEE (Institute of Electrical and Electronics Engineers) 1394 host adapters, Serial Advanced Technology Attachment (SATA) and External SATA (eSATA) host adapters, Advanced Technology Attachment (ATA) and Parallel ATA (PATA) host adapters, Fibre Channel interface adapters, Ethernet adapters, or the like. Communication interface 122 may also allow computing system 110 to engage in distributed or remote computing. For example, communication interface 122 may receive instructions from a remote device or send instructions to a remote device for execution.

As illustrated in FIG. 1, computing system 110 may also include at least one display device 124, e.g., a variable refresh rate display device coupled to communication infrastructure 112 via a display adapter 126. Display device 124 generally represents any type or form of device capable of visually displaying information forwarded by display adapter 126. Similarly, display adapter 126 generally represents any type or form of device configured to forward graphics, text, and other data for display on display device 124. In one embodiment, display device 124 may be an LCD device with a variable refresh rate. In one embodiment, the DC imbalance detection and DC imbalance remediation procedure of the present invention is programmed into firmware of display device 124 or display adapter 126. Because the DC imbalance detection and remediation procedures will typically be tailored to a respective LCD system, in a preferred embodiment, both procedures will be programmed directly into the firmware of the display device 124 or display adapter 126.

As illustrated in FIG. 1, computing system 110 may also include at least one input device 128 coupled to communication infrastructure 112 via an input interface 130. Input device 128 generally represents any type or form of input device capable of providing input, either computer- or human-generated, to computing system 110. Examples of input device 128 include, without limitation, a keyboard, a pointing device, a speech recognition device, or any other input device.

As illustrated in FIG. 1, computing system 110 may also include a primary storage device 132 and a backup storage device 133 coupled to communication infrastructure 112 via a storage interface 134. Storage devices 132 and 133 generally represent any type or form of storage device or medium capable of storing data and/or other computer-readable instructions. For example, storage devices 132 and 133 may be a magnetic disk drive (e.g., a so-called hard drive), a floppy disk drive, a magnetic tape drive, an optical disk drive, a flash drive, or the like. Storage interface 134 generally represents any type or form of interface or device for transferring data between storage devices 132 and 133 and other components of computing system 110.

In one example, databases 140 may be stored in primary storage device 132. Databases 140 may represent portions of a single database or computing device or it may represent multiple databases or computing devices. For example, databases 140 may represent (be stored on) a portion of computing system 110 and/or portions of example network architecture 200 in FIG. 2 (below). Alternatively, databases 140 may represent (be stored on) one or more physically separate devices capable of being accessed by a computing device, such as computing system 110 and/or portions of network architecture 200.

Continuing with reference to FIG. 1, storage devices 132 and 133 may be configured to read from and/or write to a removable storage unit configured to store computer software, data, or other computer-readable information. Examples of suitable removable storage units include, without limitation, a floppy disk, a magnetic tape, an optical disk, a flash memory device, or the like. Storage devices 132 and 133 may also include other similar structures or devices for allowing computer software, data, or other computer-readable instructions to be loaded into computing system 110. For example, storage devices 132 and 133 may be configured to read and write software, data, or other computer-readable information. Storage devices 132 and 133 may also be a part of computing system 110 or may be separate devices accessed through other interface systems.

Many other devices or subsystems may be connected to computing system 110. Conversely, all of the components and devices illustrated in FIG. 1 need not be present to practice the embodiments described herein. The devices and subsystems referenced above may also be interconnected in different ways from that shown in FIG. 1. Computing system 110 may also employ any number of software, firmware, and/or hardware configurations. For example, the example embodiments disclosed herein may be encoded as a computer program (also referred to as computer software, software applications, computer-readable instructions, or computer control logic) on a computer-readable medium.

The computer-readable medium containing the computer program may be loaded into computing system 110. All or a portion of the computer program stored on the computer-readable medium may then be stored in system memory 116 and/or various portions of storage devices 132 and 133. When executed by processor 114, a computer program loaded into computing system 110 may cause processor 114 to perform and/or be a means for performing the functions of the example embodiments described and/or illustrated herein. Additionally or alternatively, the example embodiments described and/or illustrated herein may be implemented in firmware and/or hardware.

For example, a computer program for determining a pre-filtered image based on a target image may be stored on the computer-readable medium and then stored in system memory 116 and/or various portions of storage devices 132 and 133. When executed by the processor 114, the computer program may cause the processor 114 to perform and/or be a means for performing the functions required for carrying out the determination of a pre-filtered image discussed above.

Dc Balancing Techniques for a Variable Refresh Rate Display

Embodiments of the present invention provide for a method and apparatus to prevent charge accumulation within the component dots of pixels in a variable refresh rate display. Embodiments of the present invention provide a method for preventing charge accumulation and resultant visual artifacts, e.g., flicker etc. by analyzing a sequence of frames to detect any DC imbalance building up within the pixels of the LCD panel. Further, embodiments of the present invention can advantageously perform DC imbalance remediation that cures for the DC imbalance by using one of several techniques. The DC imbalance remediation procedure breaks the irregular polarity pattern or beat pattern that may result in the charge running away.

In a conventional variable refresh rate display, successive frames will have roughly the same duration and alternating the polarity between successive frames will typically work to prevent charge accumulation. However, there are some scenarios where this does not hold true. For example, image sources such as graphics processing units (GPUs) can have a tendency to get into an unbalanced polarity pattern or beat pattern where the arrival interval of incoming frames alternates between longer and shorter. For example, the beat pattern may be represented as the following: +/long, −/short, +/long, −/short, etc. This can result in a DC imbalance over time.

Another example where charge build-up can result is where an LCD panel has a minimum refresh rate (or maximum frame duration) below which the panel will start to flicker. In the event that the GPU cannot keep up with the refresh rate, to combat this flicker, the driving electronics of the LCD panel or the GPU itself will repeat the prior frame to ensure that the refresh rate will not fall below this minimum threshold. FIG. 2 illustrates the manner in which repeating a prior frame to ensure that the refresh rate will not fall below a minimum threshold can result in a DC imbalance. FIG. 2 illustrates a scenario wherein the maximum frame duration of an LCD panel is set at 30 ms and frames are sent to the display from the GPU (or CPU) at a rate of 40 ms. When the 30 ms is reached, the panel will repeat the prior frame, but 10 ms after repeating the prior frame, the LCD will receive the new frame. The table in FIG. 2 illustrates the manner in which a DC imbalance will result in this situation. When the 30 ms threshold is reached, Frame 1 230, having a positive polarity, is repeated as Frame 1' 240 for an additional 10 ms, wherein Frame 1' 240 has a negative polarity. If this unbalanced polarity pattern continues as shown in the table of FIG. 2, a DC imbalance will result over time. The DC imbalance results in visual artifacts such as flicker that distort the user's experience.

Embodiments of the present invention provide a method and apparatus to combat this DC imbalance. In one embodiment, the present invention first performs DC imbalance detection. If a DC imbalance is detected, then, in one embodiment, the present invention provides different methods of remedying the DC imbalance. As mentioned above, in one embodiment, the DC imbalance detection and DC imbalance remediation procedures of the present invention can be programmed into the GPU, which is in constant communication with the LCD. In a different embodiment, the detection and remediation procedures can be programmed directly into the firmware of the LCD display. It should be noted that in a typical embodiment the DC imbalance detection and remediation are performed collectively for all pixels of the LCD screen. However, in one embodiment, the detection and correction can be performed on a per-pixel basis, however, this embodiment would typically require additional computation power and is less efficient that performing detection and remediation for all pixels collectively.

I. DC Imbalance Detection

In one embodiment, the DC imbalance detection procedure measures the duration of each frame and its polarity and adds or subtracts (depending on polarity) this time duration from an accumulator to calculate a delta duration.

However, in a different embodiment, the DC imbalance detection also models the charge leakage from the pixels on the display. Modeling the charge leakage is important because, as mentioned above, like a capacitor, the charge inside the pixels will leak over time. If the leakage is not modeled then the detection procedure may incorrectly predict accumulated charge for pixels in cases where the charge has already dissipated.

FIG. 3 illustrates computer code for computing the accumulated time duration and modeling the charge leakage for the DC imbalance detection procedure in accordance with embodiments of the invention. As shown in FIG. 3, the accumulated time duration is computed using variable delta_duration 330, wherein delta_duration accumulates the difference between variables last_positive_frame_duration and last_negative_frame_duration. The delta duration variable, delta_duration 330, is used to detect and keep track of accumulated charge.

Also, as shown in FIG. 3, the cumulative charge on the pixels of the display is modeled using variable cumulative_charge 340, wherein a leakage factor variable, leakage_factor, is used to ensure that the cumulative charge will exponentially decay back to zero if the positive and negative polarities have the same duration. In one embodiment, the leakage factor should be smaller than 1.0. Accordingly, when the panel enters a pattern where the positive and negative polarities have the same duration (delta_duration==0), the cumulative charge will exponentially decay back to zero, modeling the behavior of a regular capacitor. In one embodiment, the leakage factor could be modeled using an exponential, logarithmic, or any other linear or non-linear function in order to effectively model a similar behavior.

Variable scaling_factor scales the accumulated time duration value to an appropriate unit so it can be used to model charge. Further, in one embodiment, it can also be used to modulate the behavior of the delta_duration variable. For example, the charge may accumulate at different rates for different LCD systems in which case the combination of the leakage_factor and scaling_factor together can be chosen to more accurately model the behavior of the respective LCD system.

In one embodiment, when the absolute value of the cumulative_charge variable 340 exceeds a certain threshold value, the DC imbalance remediation function is triggered. This threshold value can be static or dynamic. In one embodiment, the threshold value is dynamic and can change depending on earlier remediation actions.

II. DC Imbalance Remediation

If a DC imbalance is detected, then embodiments of the present invention employ a DC imbalance remediation procedure that breaks the beat pattern that resulted in the accumulation of excess charge. There are several ways in which remediation can typically be handled, each one of which will be discussed in further detail below.

II. A. Controlling the Polarity of the LCD Panel

In one embodiment, the polarity of the LCD panel can be controlled in order to control the DC imbalance. This method of performing DC does not have the risk of introducing visual effects such as stutter and does not require predicting future frame arrival times. Instead control is directly exercised over the driving electronics of the LCD to tightly control the polarity in order to reverse the direction of the beat pattern.

FIG. 4A illustrates an exemplary beat pattern. FIG. 4B illustrates the manner in which the exemplary beat pattern of FIG. 4A can be reversed by controlling the driving electronics of the LCD panel in accordance with embodiments of the invention. As seen in FIG. 4A, the beat pattern comprises a frame, e.g., Frame 1 430 of positive polarity with a 20 ms duration alternating with a frame, e.g., Frame 2 431 with a 15 ms duration of negative polarity.

As shown in FIG. 4B, assuming the cumulative_charge 340 variable threshold is crossed and the polarity needs to be reversed, an external input to the driving electronics of the LCD panel can be used to change the polarity of the frames when necessary. For example, for the exemplary pattern illustrated in FIG. 4A, the input to Frame 3 432 can be switched, thereby reversing the pattern. It should be noted in this case that Frame 3 432 will have the same polarity as Frame 2 431 because the polarity of Frame 3, which was heretofore positive has been changed in order to reverse the polarity pattern. Subsequent frames, e.g., frame 4 433 will return to the alternating polarity pattern. By switching polarities and reversing the beat pattern, the DC imbalance is remedied because the accumulated charge now drifts in the opposite direction and eventually dissipates. If an accumulated charge later builds up in the opposite direction, then the polarity can be switched once again after the cumulative charge threshold is exceeded.

In one embodiment, a randomizer can be used to switch the polarity randomly at certain frame or time intervals so the accumulated charge always stays below the threshold value.

It should be noted, however, that not all LCD panels available commercially provide an external input signal to control the polarity of the frames. In such LCD panels, the polarity will always alternate from positive to negative for successive frames and other techniques for DC imbalance remediation, discussed below, need to be employed.

II. B. Repeating the Previous Frames

FIG. 5A illustrates an exemplary beat pattern (similar to the one used in FIG. 4A). FIG. 5B the manner in which the exemplary beat pattern of FIG. 5A can be reversed by repeating a prior frame in accordance with embodiments of the invention.

As seen in FIG. 5A, the beat pattern comprises a frame, e.g., Frame 1 530 of positive polarity with a 20 ms duration alternating with a frame, e.g., Frame 2 531 with a 15 ms duration of negative polarity. As shown in FIG. 5B, in one embodiment, one of the frames can be split into two frames and repeated. For example, Frame 3 532 is repeated as Frame 3' 533. Visually, nothing changes for the user of the LCD panel. Frame 3 is simply repeated as Frame 3' 533. However, as a result of this repetition, as shown in FIG. 4B, the polarity of the beat pattern switches and the cumulative charge here onwards drifts in the opposite direction. Frame 3' 533 has a negative polarity, which results in Frame 4 534 acquiring a positive polarity, whereas previously, as seen in FIG. 5A, it had a negative polarity.

In one embodiment, the technique of repeating frames to reverse the beat pattern can be employed when there is no explicit way to control the polarity, e.g., controlling the polarity of the LCD panel. It will be appreciated by one of ordinary skill in the art that this technique can only be employed when the delay between at least one pair of frames in the beat pattern is at least twice the time duration that it takes to transmit a frame to the panel from the GPU. For example, if it takes 8 ms to transmit a frame to the panel, the delay between at least one pair of frames needs to be at least 16 ms. In the example illustrated in FIG. 5B, the delay between Frame 3 532 and Frame 4 534 is 20 ms. Accordingly, Frame 3 can be split into two frames: Frame 3 532, which is 8 ms long, and repeated as Frame 3' 533, which is 12 ms long. This will not result in a temporal collision between Frame 3' 533 and Frame 4 534. This technique, therefore, works well with low refresh rates.

It will also be appreciated by one of ordinary skill in the art that the frame repetition technique of the prior invention requires the remediation procedure to make a prediction as to when the next frame will arrive in order to prevent a temporal collision between a repeated frame and the next incoming frame. This is because if a new frame arrives during the repetition of a previous frame, a temporal collision will result. This temporal collision results in the visual artifact of stutter that would not have been introduced had the frame not been repeated.

FIG. 6A illustrates an exemplary pattern wherein, assuming a minimum refresh time of 8 ms, the delay between any pair of frames is not long enough to prevent a temporal collision between a repeated frame and the next incoming frame. As shown in FIG. 6A, the delay between Frame 2 630 and Frame 3 631 is 8 ms and the delay between Frame 3 631 and Frame 4 632 is 10 ms. Since the duration between any two pairs of frames in the pattern illustrated in FIG. 6 is not at least 16 ms, there is no way to insert a duplicate frame without disrupting the starting time of the frames that follow a repeated frame.

In one embodiment, if there is no way for the LCD driving electronics to inform the image source, e.g., a GPU to slow the frame feed, the driving electronics will need to hold off the frames following a repeated frame to avoid the imbalance. FIG. 6B illustrates the manner in which start times of frames are delayed for the exemplary pattern illustrated in FIG. 6B in order to repeat a frame in accordance with embodiments of the invention. Because Frame 3 631 is repeated as Frame 3' 638, the cumulative duration of Frame 3 631 and Frame 3' 638 needs to be at least 16 ms in order to accommodate the minimum refresh time of 8 ms. Since the duration of Frame 3 631 as shown in FIG. 6A is only 10 ms, the start time of Frame 4 639 needs to be delayed 6 ms in order to repeat Frame 3. Accordingly, Frame 4 639 now starts at 34 ms as shown in FIG. 6B as compared with the original start time of 28 ms as shown in FIG. 6B. Similarly, Frame 5 640 is also delayed 6 ms. As shown in FIG. 6B, a certain number of frames following Frame 4, e.g., Frame 5 640, Frame 6 633, Frame 7 634, Frame 8 635, and Frame 9 636 will need to be delayed by the LCD driving electronics and displayed at the minimum refresh interval before incoming frame arrival times will match the LCD refresh start times again. As shown in FIG. 6B, after displaying several frames at the minimum refresh interval rate, the frame arrival time matches the LCD refresh start times again at Frame 10 637 and the beat pattern resumes.

Inserting a New Frame Spaced Evenly Between the Prior Frame and the Next Frame

In one embodiment, the inserted frame, e.g., Frame 3' 533 is repeated as soon as the previous frame, e.g., Frame 3 532 has completed, wherein the previous frame is refreshed at the minimum refresh time, e.g., 8 ms. This minimizes the chance that the next real frame, e.g., Frame 4 534 will have a temporal collision with the repeated frame.

However, in some cases, the image source can be highly predictable and have low refresh rates. Accordingly, in one embodiment, the repeated frame (or frames), e.g., Frame 3' 533 is spaced evenly between the prior frame, e.g., Frame 3 532 and the next frame, e.g., Frame 4 534. As a result, the DC balance can stay constant and no further remediation is needed. By way of example, if only a single frame is repeated, it can be inserted in the middle of the previous frame and the following frame. By way of further example, in the case of two repeated frames, the first frame may be spaced ⅓ of the way from the previous frame and the second frame may be spaced ⅔ of the way from the previous frame.

FIG. 7 illustrates the manner in which a repeated frame can be spaced evenly between a prior and a subsequent frame in accordance with embodiments of the invention. Inserted Frame 1' 731 is evenly spaced between prior frame, Frame 1 730, and the next frame, Frame 2 732. By positioning the repeated frame right in the middle, this DC imbalance can be avoided entirely. This embodiment can be useful for panels that have a minimum refresh rate.

A typical example of this embodiment would be a video source that plays a movie at a constant 24 frames per second (fps), below the minimum refresh rate of 30 fps of a panel. By inserting the repeated frames evenly, the refresh rate can be up converted to 48 fps or 72 fps, while keeping the DC balance constant.

II. C. Dropping an Incoming Frame

In one embodiment, a drifting DC bias charge can be reined in and reverted by completely dropping an incoming frame. As a result of dropping a frame, the polarity of the beat pattern switches and the cumulative charge subsequently drifts in the opposite direction.

FIG. 8A illustrates an exemplary beat pattern. FIG. 8B illustrates the manner in which the exemplary beat pattern of FIG. 8A can be reversed by dropping an incoming frame in accordance with embodiments of the invention. As illustrated in FIG. 8B, when Frame 4 830 is dropped, the polarity of Frame 5 831 is now reversed as it acquires a negative polarity in comparison to the positive polarity it had in FIG. 8A before Frame 4 was dropped.

In one embodiment, the technique of dropping an incoming frame to reverse the beat pattern is employed only when the frame refresh rate is high or close to the maximum refresh rate. Accordingly, dropping a frame will not be visible to the naked eye.

II. D. Adjusting Frame Launch Time

In one embodiment, continuous minor adjustments can be made to the LCD refresh start time to even out the time duration differences between alternating frames. As a result, the accumulation of DC bias charge is prevented.

FIG. 9A illustrates an exemplary beat pattern. As shown in FIG. 9A, the beat pattern comprises frames of 10 ms alternating with frames of 12 ms. FIG. 9B illustrates the manner in which the LCD refresh start times of the exemplary beat pattern of FIG. 9A can be continuously adjusted to prevent DC imbalance charge from building. As shown in FIG. 9B, Frame 2 930 is delayed by 1 ms so that its total duration is 11 ms. Frame 3 931, instead of starting at 22 ms as shown in FIG. 9A, now starts at 23 ms, as shown in FIG. 9B. Further, because the LCD driving electronics launches Frame 3 391 at a later time, its total duration is reduced by 1 ms.

As a result, both the positive and negative polarity frames have equal duration, which prevents DC bias charge build-up. As shown in FIG. 9B, this pattern is maintained for the remaining frames, wherein every other frame is delayed by 1 ms. This results in all frames having equal time duration and the DC imbalance is, therefore, removed.

II.E. Imbalance Remediation at Image Source

In a typical embodiment, as discussed above, the imbalance remediation procedure can be programmed into the LCD driving electronics, so that the image source, e.g., the GPU can be agnostic as to the changes made to the frames after they have been transmitted over to the LCD. As frames enter the display logic of the LCD panel, the different remediation techniques can be applied at the LCD level, e.g., change of polarity, repeating, dropping or delaying frames.

In a different embodiment, however, the image source can be programmed with the intelligence to ensure that pairs of frames with opposite polarities have roughly the same duration. In this embodiment, for example, a GPU would track the DC imbalance using the DC imbalance detection techniques described above. Further, upon crossing the cumulative charge threshold, it would also deliberately delay frame transmission or rendering times when required to remedy the imbalance.

III. Imbalance Remediation Frequency

In one embodiment, the threshold before any remediation is performed can be set relatively high. This may be done because, in most cases, DC imbalance does not result in visual flicker immediately. Further, because certain remediation techniques, e.g., frame repetition, may cause stutter, it may be preferable to delay remediation as long as possible, up until just before visual distortion results.

In such an embodiment, however, where the cumulative charge threshold is set fairly high, it is possible that the frame time regimen changes once in remediation mode. For example, after a frame is repeated to invert the polarity pattern, the frame sequence could change such that the polarity pattern reverses again which may cause the cumulative charge threshold to be exceeded again. If this happens often enough, it could result in a number of repetitions in a short time and visual stutter.

FIG. 10 illustrates an exemplary beat pattern for which a high cumulative charge threshold could be problematic. For the pattern illustrated in FIG. 10, remediation is not necessary since Frame 5 1032 inverts the pattern. Prior to Frame 5, the positive polarity frames have a 20 ms duration, however, after Frame 5, which reverses the pattern, all the positive polarity frames have a 15 ms duration.

Assuming, the cumulative charge threshold is set high and one of the frames prior to Frame 5 caused remediation to be triggered, then Frame 5, which does not fit the steady state beat pattern, would cause the pattern to erroneously reverse in the wrong direction. In other words, the irregular Frame 5 would cause the DC bias charge to continue to accumulate in the wrong direction. As a result, another remediation would be required in a relatively short time frame. If frame repetitions are being used to correct for DC imbalance, then frequent frame repetitions would be required resulting in visual stutter. Therefore, setting the threshold high can be problematic in some cases, e.g., where the beat pattern is an irregular beat pattern such as the one illustrated in FIG. 10.

Accordingly, in one embodiment, it is advantageous to reduce the first threshold to a value that is low enough such that the threshold can be increased after the first remediation. This ensures that the second remediation does not take place too soon after the first one and reduces the chances of continuous remediation even in instances of an irregular beat pattern such as the one illustrated in FIG. 10.

In one embodiment, wherein the refresh rate is low and the duration of all frames is at least twice the minimum LCD refresh interval e.g., for a panel with an 8 ms minimum refresh time and a pattern with all frames arriving more than 16 ms from each other, a different strategy may be employed. In this embodiment, the remediation threshold can be set to low. Even if an irregular beat pattern is encountered and frame repetitions need to happen in quick succession, they will still complete in time before the respective next frames arrive and temporal collisions will, as a result, be avoided. The advantage of this method is that the DC balance will remain close to 0 instead of lingering around a higher threshold value.

IV. DC Imbalance Remediation Without DC Imbalance Detection

As discussed above, in a typical embodiment, DC imbalance remediation actions are triggered in response to a DC imbalance detection procedure. This, however, may not be necessary. DC imbalance issues will typically only show up when there is a prolonged exposure to an imbalanced beat pattern. In one embodiment, DC imbalance remediation can be triggered at intervals that are determined by a pseudo-random generator. If the average remediation interval is shorter than a typical beat pattern, this technique will break out the beat patterns and will result with a mostly balanced DC level.

In one embodiment, DC polarity control method is used to randomly switch the polarity of the frames because other techniques can risk the chance of distorting a user's visual experience.

V. Method of Performing DC Balancing for a Variable Refresh Rate Display

Figure 11:
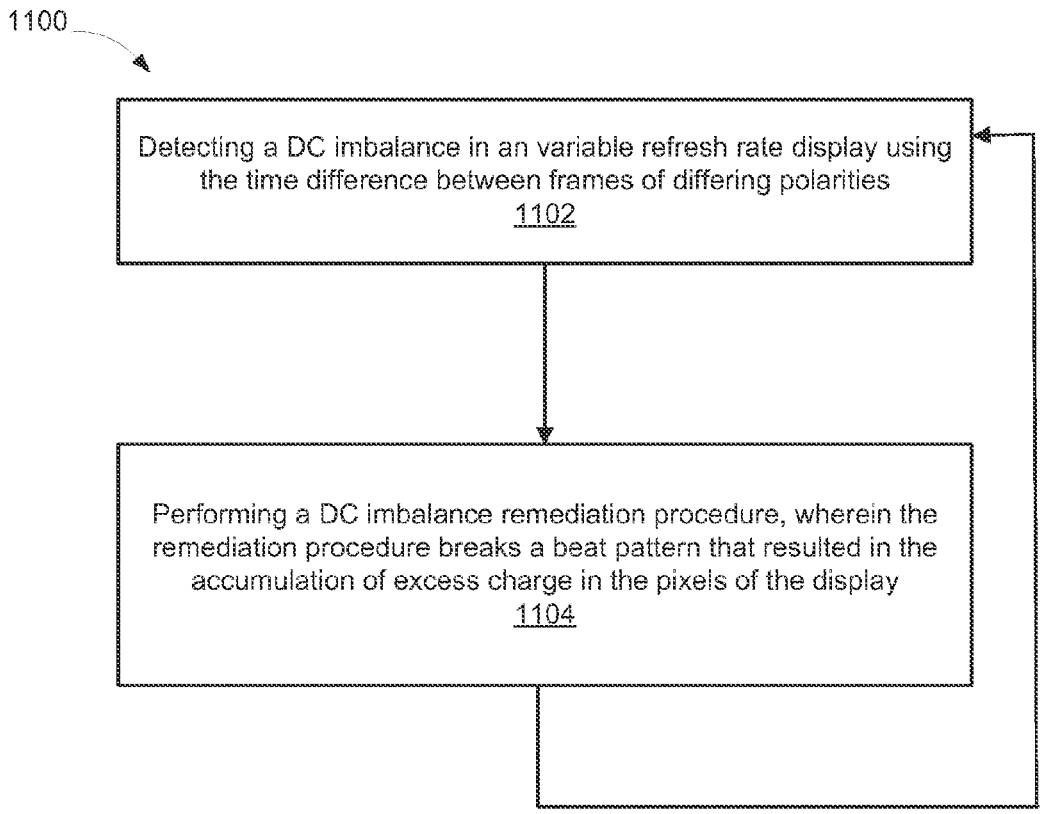
FIG. 11 shows a flowchart of an exemplary computer-implemented process of performing DC balancing for a variable refresh rate display in accordance with embodiments of the present invention.

FIG. 11 shows a flowchart 1100 of an exemplary computer-implemented process of performing DC balancing for a variable refresh rate display in accordance with embodiments of the present invention. While the various steps in this flowchart are presented and described sequentially, one of ordinary skill will appreciate that some or all of the steps can be executed in different orders and some or all of the steps can be executed in parallel. Further, in one or more embodiments of the invention, one or more of the steps described below can be omitted, repeated, and/or performed in a different order. Accordingly, the specific arrangement of steps shown in FIG. 11 should not be construed as limiting the scope of the invention. Rather, it will be apparent to persons skilled in the relevant art(s) from the teachings provided herein that other functional flows are within the scope and spirit of the present invention. Flowchart 1100 may be described with continued reference to exemplary embodiments described above, though the method is not limited to those embodiments.

In a block 1102, using a DC imbalance detection procedure, a bias charge imbalance is detected in a variable refresh rate display using an accumulated time difference between frames of differing polarities. In one embodiment, as discussed in detail above, the DC imbalance detection procedure also models the charge leakage from the pixels on the display.

In a block 1104, a DC imbalance remediation procedure is performed, wherein the remediation procedure breaks a beat pattern on the variable refresh rate display that resulted in the accumulation of excess charge in the pixels of the display. Several different remediation procedures can be employed, e.g., controlling the polarity of the LCD panel wherein an extra positive or negative polarity frame is inserted to combat the DC imbalance, forcing a repeat of a frame to reverse the beat pattern, dropping a frame completely to reverse the beat pattern, adjusting the refresh times of individual frames to even out the positive and negative polarity intervals and slowing down the image source to break the beat pattern. Following DC imbalance remediation, the procedure is repeated continuously for incoming frames from the image source.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered as examples because many other architectures can be implemented to achieve the same functionality.

The process parameters and sequence of steps described and/or illustrated herein are given by way of example only. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

While various embodiments have been described and/or illustrated herein in the context of fully functional computing systems, one or more of these example embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. These software modules may configure a computing system to perform one or more of the example embodiments disclosed herein. One or more of the software modules disclosed herein may be implemented in a cloud computing environment. Cloud computing environments may provide various services and applications via the Internet. These cloud-based services (e.g., software as a service, platform as a service, infrastructure as a service, etc.) may be accessible through a Web browser or other remote interface. Various functions described herein may be provided through a remote desktop environment or any other cloud-based computing environment.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as may be suited to the particular use contemplated.

Embodiments according to the invention are thus described. While the present disclosure has been described in particular embodiments, it should be appreciated that the invention should not be construed as limited by such embodiments, but rather construed according to the below claims.

What is claimed is:

1. A method for driving a display panel having a variable refresh rate, said method comprising:

detecting a condition that results in a charge accumulation in said display panel using an accumulated difference in time duration between frames of positive polarity and frames of negative polarity received from an image source, wherein said DC imbalance is a result of a beat pattern comprising alternating frames of differing polarities, wherein each frame of positive polarity within said beat pattern is of a different time duration than each frame of negative polarity, and wherein said beat pattern results in an accumulation of charge in pixels of said display panel;

and correcting for said charge accumulation by disrupting said beat pattern, wherein said correcting comprises one of:

adjusting a refresh time of frames in said beat pattern in order for said frames of positive polarity in said beat pattern to be equal in time duration to said frames of negative polarity in said beat pattern;

delaying rendering of frames in said beat pattern at said image source in order for said frames of positive polarity in said beat pattern to be equal in time duration to said frames of negative polarity in said beat pattern.

2. The method of claim 1, wherein said correcting further comprises:

toggling an input to said display panel, wherein said toggling switches a polarity of a frame in said beat pattern and reverses said beat pattern.

3. The method of claim 2, wherein an external input to driving electronics for the display panel can be used to change said polarity of said frame in said beat pattern.

4. The method of claim 1, wherein said correcting further comprises:

repeating a frame in said beat pattern, wherein said repeating reverses said beat pattern.

5. The method of claim 4, wherein a repeated frame is evenly spaced between a frame prior to said repeated frame and a frame subsequent to said repeated frame.

6. The method of claim 1, wherein said correcting further comprises:

dropping a frame in said beat pattern, wherein said dropping reverses said beat pattern.

7. The method of claim 1, wherein said image source is a graphics processing unit (GPU).

8. The method of claim 1, wherein said detecting further comprises:

modeling said accumulation of charge to decay in response to time durations of said frames of positive polarity and said frames of negative polarity being equal.

9. A system comprising:

a variable refresh rate display;

a memory for storing images from an image source;

a processor coupled to said memory, said processor operable to implement a method for controlling said variable refresh rate display, said method comprising:

detecting a condition that results in a DC imbalance in said variable refresh rate display using an accumulated difference in time duration between frames of positive polarity and frames of negative polarity received from said image source, wherein said DC imbalance is a result of a beat pattern comprising alternating frames of differing polarities, wherein each frame of positive polarity within said beat pattern is of a different time duration than each frame of negative polarity, and wherein said beat pattern results in an accumulation of charge in pixels of said variable refresh rate display;

and correcting for said DC imbalance by disrupting said beat pattern, wherein said correcting comprises one of:

adjusting a refresh time of frames in said beat pattern in order for said frames of positive polarity in said beat pattern to be equal in time duration to said frames of negative polarity in said beat pattern;

delaying rendering of frames in said beat pattern at said image source in order for said frames of positive polarity in said beat pattern to be equal in time duration to said frames of negative polarity in said beat pattern.

10. The system of claim 9, wherein said correcting further comprises:

toggling an input to said variable refresh rate display, wherein said toggling switches a polarity of a frame in said beat pattern and reverses said beat pattern.

11. The system of claim 9, wherein said correcting further comprises:

repeating a frame in said beat pattern, wherein said repeating reverses said beat pattern.

12. The system of claim 11, wherein a repeated frame is evenly spaced between a frame prior to said repeated frame and a frame subsequent to said repeated frame.

13. The system of claim 9, wherein said correcting further comprises:

dropping a frame in said beat pattern, wherein said dropping reverses said beat pattern.

14. The system of claim 9, wherein said image source is a graphics processing unit (GPU).

15. The system of claim 9, wherein said variable refresh rate display is a Liquid Crystal Display (LCD) panel.

16. The system of claim 9, wherein said detecting further comprises:

modeling said accumulation of charge to decay in response to time durations of said frames of positive polarity and said frames of negative polarity being equal.

17. A method for controlling a display panel with a variable refresh rate, said method comprising:

determining intervals to perform DC imbalance correction in a variable refresh rate display using a pseudo-random generator, wherein said DC imbalance is a result of a beat pattern comprising alternating frames of differing polarities, wherein each frame of positive polarity within said beat pattern is of a different time duration than each frame of negative polarity, and wherein said beat pattern results in an accumulation of charge in pixels comprising said variable refresh rate display;

and correcting for said DC imbalance at said intervals by disrupting said beat pattern, wherein said correcting comprises one of:

adjusting a refresh time of frames in said beat pattern in order for said frames of positive polarity in said beat pattern to be equal in time duration to said frames of negative polarity in said beat pattern;

delaying rendering of frames in said beat pattern at said image source in order for said frames of positive polarity in said beat pattern to be equal in time duration to said frames of negative polarity in said beat pattern.

18. The method of claim 17, wherein said correcting further comprises:

toggling an input to said variable refresh rate display, wherein said toggling switches a polarity of a frame in said beat pattern and reverses said beat pattern.

* * * * *